United States Patent [19]

Bellafiore

[11] 4,417,542

[45] Nov. 29, 1983

[54] APPARATUS FOR COATING NARROW VERTICAL ELONGATED SPACES

[75] Inventor: Francis V. Bellafiore, Joliet, Ill.

[73] Assignee: Chicago Bridge & Iron Company, Oak Brook, Ill.

[21] Appl. No.: 405,162

[22] Filed: Aug. 5, 1982

[51] Int. Cl.[3] ..... B05B 13/06; B05B 13/00

[52] U.S. Cl. ..... 118/306; 118/305; 118/317; 118/323

[58] Field of Search ..... 118/305, 306, 317, 323

[56] References Cited

U.S. PATENT DOCUMENTS 4,167,151 9/1979 Muraoka et al. ..... 118/323 X

*Primary Examiner*—James R. Hoffman

*Attorney, Agent, or Firm*—Merriam, Marshall & Bicknell

[57] ABSTRACT

Apparatus for applying a coating to one of two walls forming a narrow vertical elongated space comprising a vertical guide track supporting a vertically displaceable carriage thereon adapted to removably fit in the said narrow vertical elongated space; a power driven system for vertically displacing the carriage; and a system supported by the guide track for releasably securing the guide track against movement lateral to the two walls and sideways in the narrow vertical elongated space.

10 Claims, 7 Drawing Figures

28
70
6.
60
36
96
64
100
64
26
102
90
72
86
62
70
76
82
80
32
42
16
100
38
140
30
134
136
132
134
138
101
105
34
14
126
24
104
124
114
122
128
131
130
104
46
105
150
50
12
22
18
54
6.
20

APPARATUS FOR COATING NARROW VERTICAL ELONGATED SPACES

This invention relates to apparatus for, and methods of, coating objects and structures. More particularly, this invention pertains to novel apparatus for, and methods of, applying a coating to at least one of two walls forming a narrow vertical elongated space, such as an insulation layer in the annular space formed by the walls of a large double walled storage tank.

BACKGROUND OF THE INVENTION

It is not uncommon for various structural objects to be built which include two spaced apart walls which form a relatively narrow vertical elongated space which is straight or curved. At times it is desirable, and even necessary, to apply a coating to one or both of the walls. The coating can be in the nature of a paint or it can be an insulating material, particularly a polymeric insulating material, such as one which is foamed in place.

A specific structure having a relatively narrow vertical elongated space between spaced apart walls is a storage tank for liquids stored at temperatures significantly above or below ambient temperature. Such a tank generally has inner and outer shells which include spaced apart inner and outer vertical cylindrical circular walls made of metal plate. The spaced apart walls define an annular space in which insulation is placed to retard heat leak through the walls. Such tanks are disclosed in U.S. Pat. Nos. 3,147,878 and 3,352,443. As disclosed in those patents, the insulating material can be a granular material such as expanded perlite, used alone or with a resilient insulating blanket.

While the described insulating systems have been satisfactory, it is desirable to further improve the insulation system. One way to do this is to apply a foamed-in-place insulating layer of a polymeric material, such as polyurethane, to one or both of the walls defining the annular space between the two tank walls. The annular space is generally only about 3 to 5 feet wide but 30 to 100 feet or more high. Manual application of foamed-in-place insulation to one or both of the walls in such cramped limiting space is tedious, difficult and expensive. A need accordingly exists for apparatus and methods of coating one or more of the walls in such narrow elongated space which can be operated automatically and remotely so as to avoid most or all need for manual coating the walls.

U.S. Pat. No. 4,167,151 discloses a vertical track having two rails on which a carriage rides vertically. The carriage has a spray gun by which foamed-in-place insulation is applied to a vertical surface. However, the apparatus is not taught to be useful in a narrow vertical space nor does it have means to releasably secure it in place in such space against lateral or sideways movement.

SUMMARY OF THE INVENTION

According to one aspect of the invention, there is provided apparatus for applying a coating to at least one of two walls forming a narrow vertical elongated space comprising a vertical guide track supporting a vertically displaceable carriage thereon adapted to fit in the said narrow vertical elongated space; power driven means for vertically displacing the carriage; and means on the guide track for releasably securing the guide track against movement lateral to the two walls and sideways in the narrow vertical elongated space.

The vertical guide track height will generally be at least as high as the narrow vertical elongated space. Furthermore, the guide track advisably has at least two vertical spaced apart parallel rails on which the carriage is mounted for vertical displacement.

The power driven means for vertically displacing the carriage can include a reversible winch and a wire rope operatively wound on the winch and connected to the carriage to positively displace the carriage vertically upwardly. It can move downwardly readily by gravity upon release of the winch.

The apparatus can be provided with roller means on the top portion of the guide track for guiding the track in the narrow vertical elongated space on a horizontal member connected to one of the walls.

Spray means will usually be provided on the carriage for applying a coating to one of the wall surfaces as the carriage is displaced vertically. The spray means can include reciproacting means for applying the coating as horizontal passes of predetermined length so that a coating can be applied as a vertical band with vertical displacement of the carriage. The full thickness of the insulating material can be applied as one layer or as several separate thin layers applied one after the other. A single full thickness layer, or a thin layer, can be applied in one vertical movement of the carriage.

Regardless of the type of spray means used, it is advisable that it be capable of being fed, controlled and observed by means located outside of the narrow space between the walls. Means can be placed on the carriage for remote observation of the wall area being coated. A television camera is suitably used for this purpose with a television receiver connected to the camera located outside of the narrow space.

The means for releasably securing the guide track against movement lateral to the two walls or sideways in the narrow vertical elongated space can include at least one vacuum box which is releasably attachable to one of the walls by creating a vacuum in the box.

The lower end of the guide track desirably has rollers which cooperate with a rail mounted on the floor of the elongated space to keep the track positioned properly relative to the two walls and to facilitate lateral movement of the guide track.

According to a second aspect of the invention, there is provided a method of applying a coating to one of two walls forming a narrow vertical elongated space comprising positioning, in the narrow vertical elongated space, an apparatus comprising a vertical guide track supporting a vertically displaceable carriage thereon, said carriage having means to apply a coating to one of the said walls; securing the guide track against movement lateral to the two walls and sideways in the narrow vertical elongated space; moving the carriage vertically on the guide track while applying a coating from the carriage to one of the said walls as a vertical band extending for a substantial part of the height of the elongated space; moving the guide track adjacent an area of the same wall which has not been so coated and again securing the guide track against lateral and sideways movement; moving the carriage vertically on the guide track while applying a coating from the carriage to the same wall as a vertical band extending for a substantial part of the height of the elongated space; and repeating the described application of coating bands until a substantial portion of the wall is coated.

The wall can be coated by placing successive coating bands adjoining previously applied coating bands.

The coating can be any suitable material, such as a paint or an insulating material. A formed-in-place polymeric material, such as polyurethane, is a suitable insulating material.

Each coating band can be applied by spraying the coating on in horizontal passes or in such other pattern as is considered appropriate.

The method is especially useful in coating one or both of vertical cylindrical circular walls equally spaced apart from each other, such as in a liquid storage tank. Such walls will usually be made of metal plate or concrete.

DETAILED DESCRIPTION OF THE DRAWINGS

To the extent it is reasonable and practical, the same numbers will be used in the various drawings to identify the same or similar elements.

Figure 1:
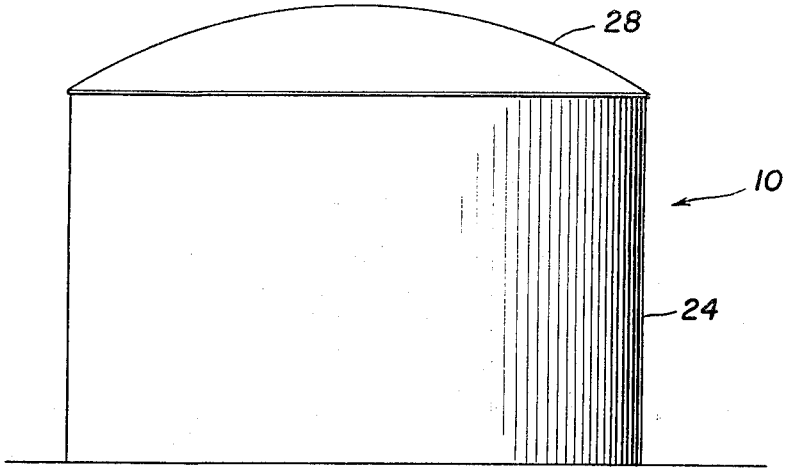
FIG. 1 is an elevational view of a double walled storage tank.
Figure 2:
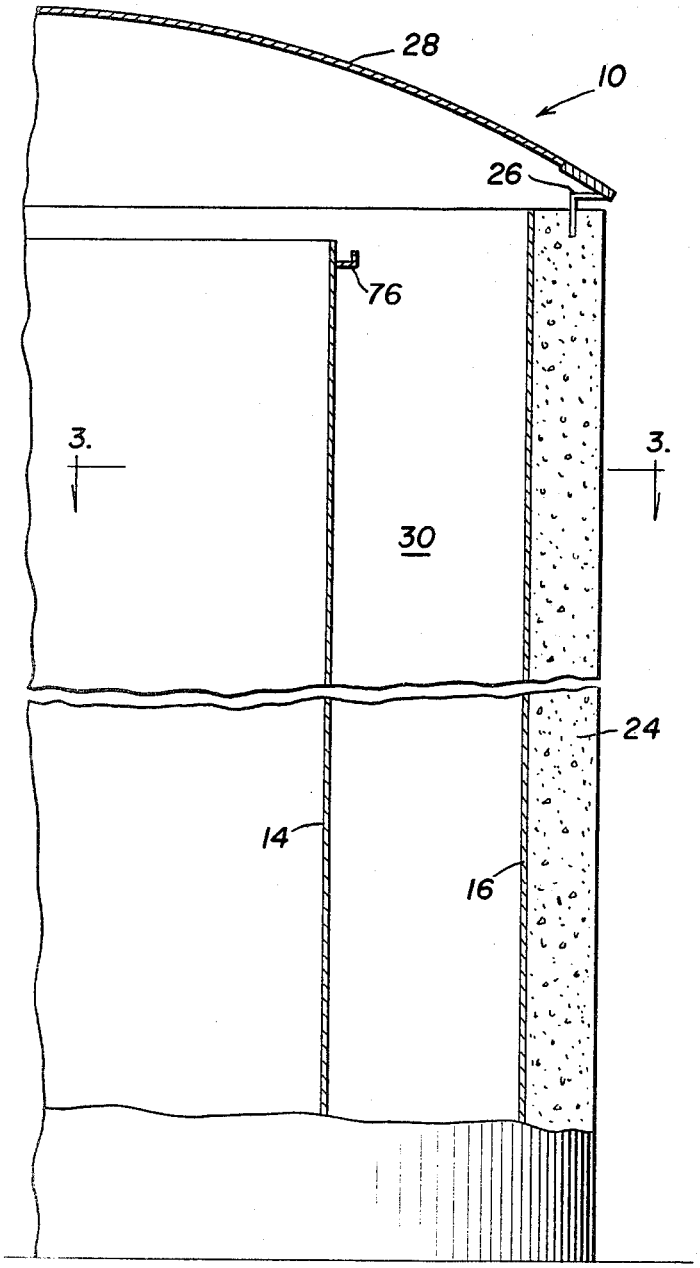
FIG. 2 is a partial vertical sectional view of the storage tank shown in FIG. 1.
Figure 3:
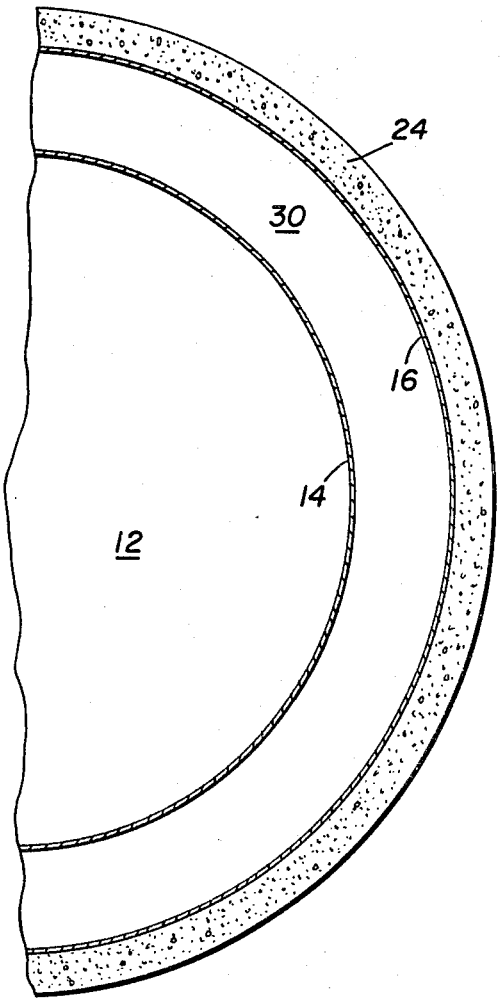
FIG. 3 is a partial sectional view taken along the line 3—3 of FIG. 2.
Figure 4:
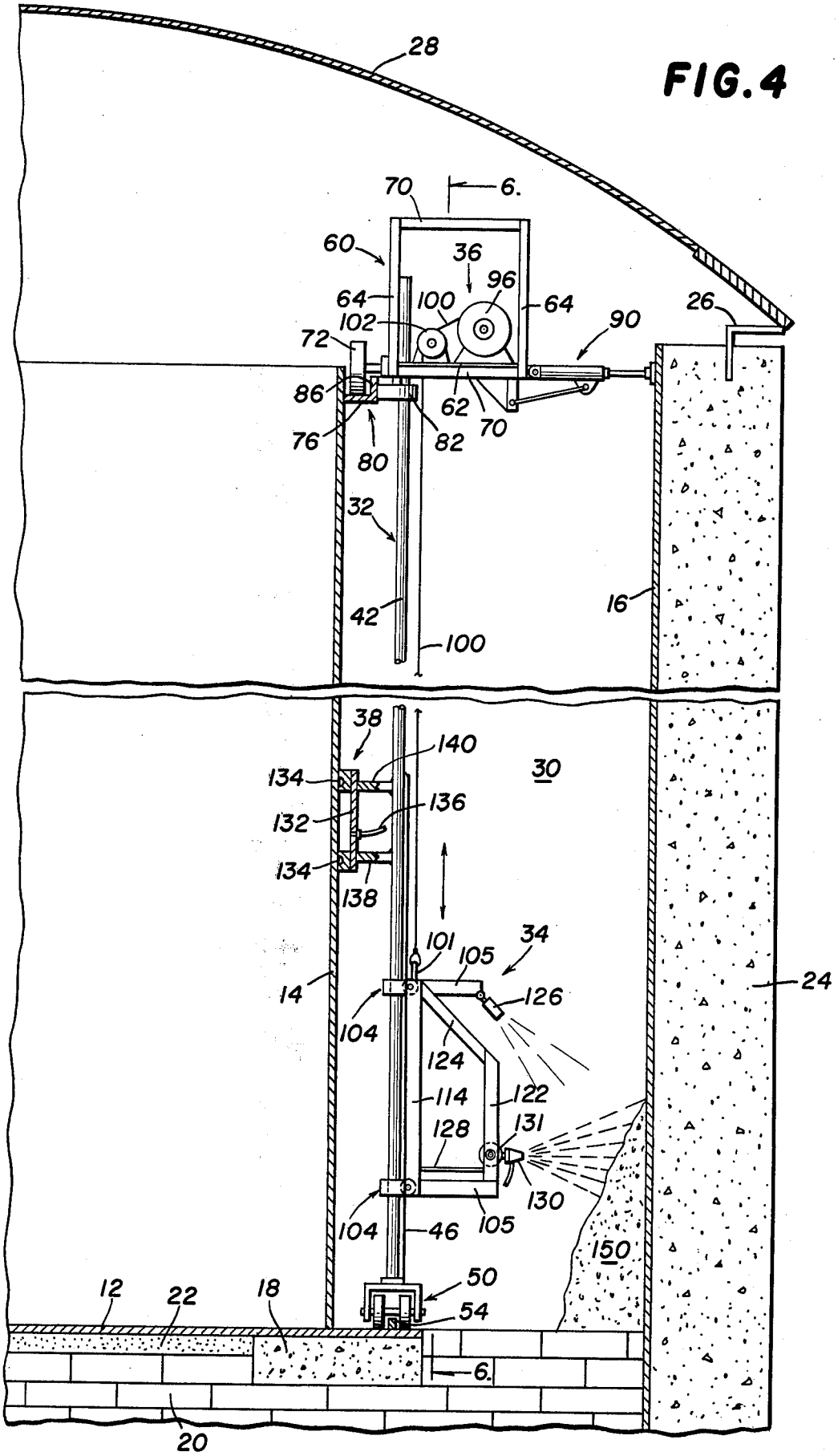
FIG. 4 is an enlarged more detailed view similar to FIG. 2 but with the insulation foam applying apparatus of the invention in place.

With reference to FIGS. 1 to 4, liquid storage tank 10 includes a flat metal inner bottom 12, an inner vertical cylindrical metal wall 14 connected at its lower edge of bottom 12 and an outer vertical cylindrical metal wall 16. The lower portion of outer metal wall 16 extends downwardly beyond the peripheral edge of the inner metal bottom, to which it is joined, into connection with an outer metal bottom, not shown. Load bearing footing 18 and insulating blocks 20 are located between the inner and outer metal bottoms (FIG. 4). A layer of sand 22 or similar material can be placed beneath inner bottom 12 to help distribute the load.

A thick concrete wall 24, which may be optional, can be placed around and in contact with the outer surface of outer metal wall 16. The vertical leg of angle 26 can be partially embedded in the top of concrete wall 24. The outer edge of domed roof 28 is supported by and joined, such as by welding, to angle 26.

The tank as structurally described above will be seen to comprise a primary liquid containment vessel which consists mainly of inner bottom 12 and inner wall 14, and a secondary liquid containment vessel made up primarily of an outer metal bottom (not shown) and outer metal wall 16, concrete wall 24 and domed roof 28. The tank will usually also include a suspended insulated ceiling (not shown) which is horizontally arranged within the peripheral part of inner wall 14 and suspended by rods from domed roof 28. Such a suspended ceiling is shown in U.S. Pat. No. 3,352,443. A suspended ceiling is not the only way the primary containment vessel can be closed at the top since, for example, a domed roof like roof 28 can be used.

As will be readily apparent, the inner and outer walls 14 and 16 define an annular elongated space 30 of essentially uniform width extending vertically for the height of the walls. In the event a very cold liquid is stored in the tank and the primary containment vessel fails, escaping liquid will be retained by the secondary containment vessel. However, to guarantee that the outer metal wall 16 will not fail when subjected rapidly to a much lower temperature, it is desirable that the inner surface of metal wall 16 be covered with a suitable thermal insulation layer, especially foamed polyurethane. Manually applying a layer of foam insulation to that wall presents practical problems because the width of the annular space 30 is only about 3 to 5 feet. An operator thus has very little space in which to work and because of the cramped environment can only work a comparatively short time without relief. The apparatus and method subsequently described in connection with the drawings provides for semi-automatic deposition of insulating foam on the wall with minimum need for supplemental manual deposition of insulating foam.

Figure 5:
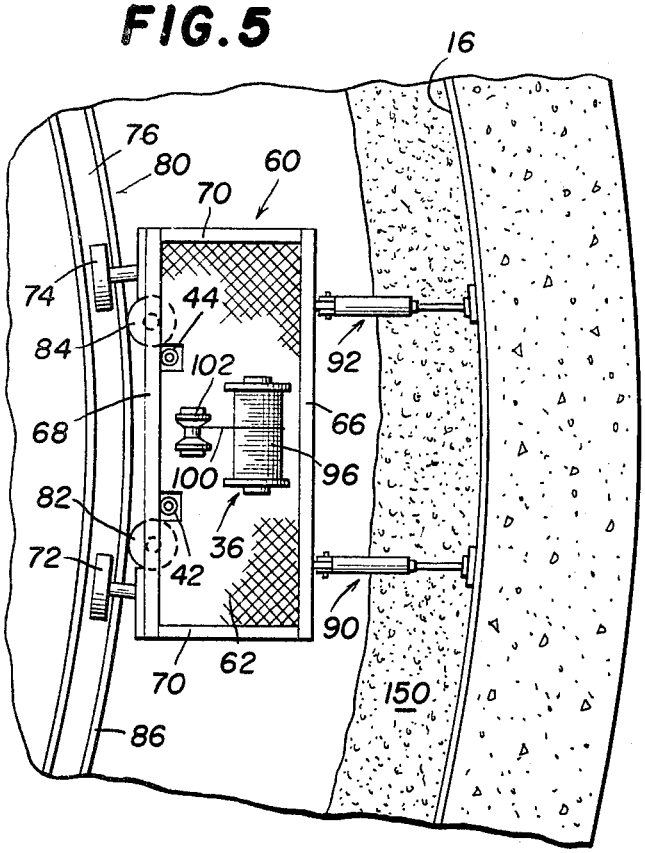
FIG. 5 is a plan view of the top part of the insulation foam applying apparatus shown in FIG. 4.
Figure 6:
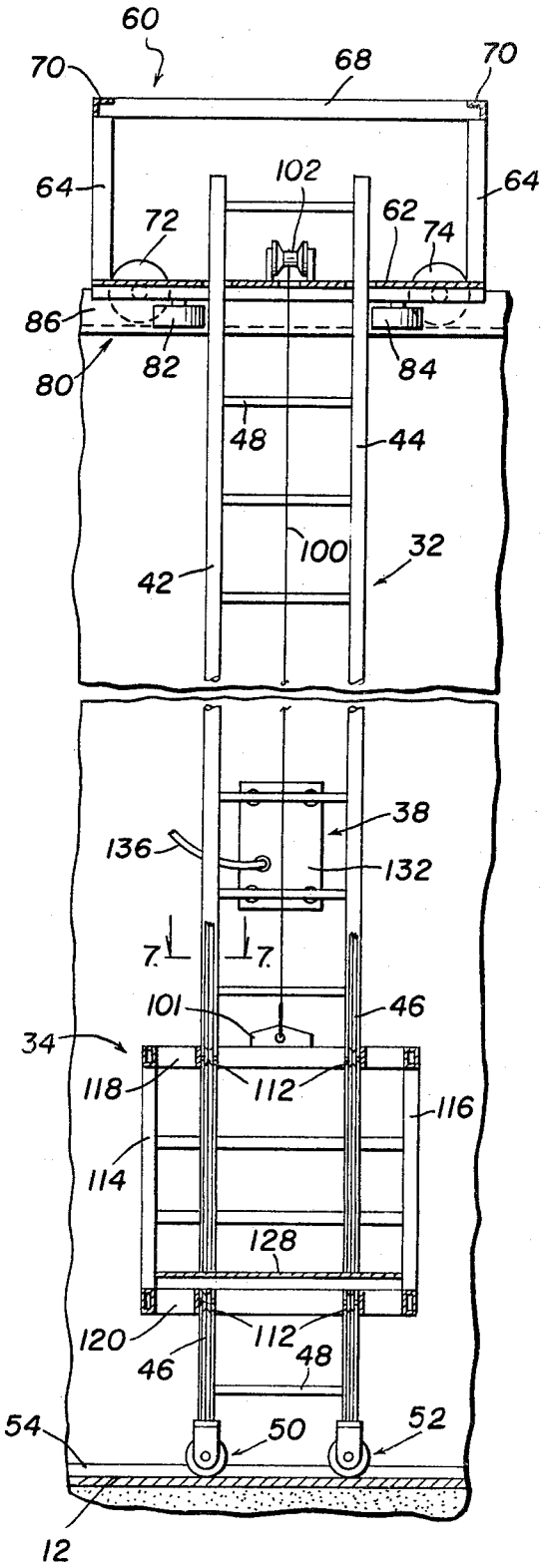
FIG. 6 is an elevational view taken partially in section along the line 6—6 of FIG. 4.

As shown in FIGS. 4 to 6, the apparatus of the invention includes a vertical guide track 32, a vertically displaceable carriage 34 supported by the track 32, a power driven means 36 for vertically displacing the carriage, and means 38 supported by the track for releasably securing the track against movement lateral to the walls 14 and 16 and sideways in space 30.

The guide track 32 includes a pair of identical tubular spaced apart vertical rails 42 and 44, each of which has an angle member rib 46 welded on it and extending for its length. A plurality of horizontal spaced apart rungs 48 extend between rails 42 and 44 and are joined thereto to more or less form a ladder-like structure.

The lower end of each of rails 42 and 44 is provided with a pair of spaced apart twin rollers 50 and 52 adapted to straddle a guide rail 54 secured on the top of inner bottom 12. In this way, the track 32 lower end is prevented from shifting radially and thereby maintains a predetermined position relative to walls 14 and 16.

A cage 60 is mounted on the upper part of track 32. Cage 60 includes a floor or platform 62 supported beneath all four edges by angle members. Corner supports 64 extend vertically upwards from each of the four corners of the floor 62 and horizontal front and back members 66 and 68, and side members 70, are joined to their upper ends.

A pair of spaced apart rollers 72 and 74, which roll on horizontal axles, are positioned on the back of platform 62. These rollers roll on the horizontal flange 76 of angle 80 which is joined near the top of the outer surface of inner wall 14. To synchronize the track load borne at the top by rollers 72 and 74, rollers 50 and 52 at the bottom can be mounted on spring means (not shown). A pair of spaced apart rollers 82 and 84 is mounted on the bottom of platform 62 to rotate on vertical axles. The rollers 82 and 84 are positioned to rollably contact the vertical flange 86 of angle 80.

Extending horizontally outwardly from the front of platform 62 is a pair of pneumatically extendable and retractable arms 90 and 92 capable of contacting outer wall 16 with sufficient pressure to stabilize the upper part of the track when insulation foam is deposited.

Platform 62 supports a power operated winch 96 on which wire rope 100 is wound and unwound. Wire rope 100 extends over grooved guide roller 101, also mounted on platform 62, and runs vertically downwardly. The end of wire rope 100 is then connected to an attachment plate 101 on the top of carriage 34.

Figure 7:
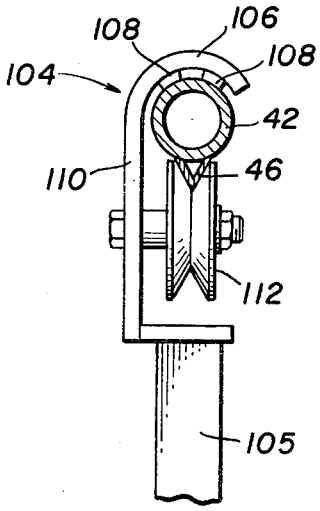
FIG. 7 is a sectional view taken along the line 7—7 of FIG. 6.

The cage 60 can be movably stabilized on track 32 by any suitable means. One acceptable means is shown in FIG. 7. Thus, hooked member 104 can be ridgedly attached to a supporting arm 105. Arms 105 can be mounted on cage 60 slightly beneath, and also spaced above, platform 62 so that two members 104 engage each of rails 42 and 44. The curved part 106 of member 104 has two spaced apart vertically arranged linear bearings 108 joined to it and adapted to contact the adjacent leg 42 or 44 as the case may be. The straight shank portion 110 of each member 104 contains a grooved roller 112 which is adapted to roll on guide 46. By means of the described system the cage can be maintained on track 32 and vertical displacement permitted. However, it is desirable to provide a locking means so that the cage can be secured against movement on the track, such as when insulation is being deposited.

Also mounted on track 32 is carriage 34. The carriage has left and right side portions and each side portion has an upper and lower lower arms 105 with a hooked member 104 secured at each end. In this manner one carriage side portion is vertically movably secured to rail 42 and the other side portion is vertically movably secured to rail 44. Vertical bars 114, 116 are joined at their upper and lower ends to horizontal bars 118 and 120. Vertical members 122 extend upwardly from the front ends of the lower arms 105 and are joined to sloped braces 124 which are joined at their upper ends to horizontal bar 118. A television camera 126 is mounted on the upper part of the carriage so that the area to which insulation is to be applied can be remotely observed. A light can also be mounted on the carriage to illuminate the work area. A floor or deck 128 is optionally provided on the lower part of the carriage to support foaming equipment and controls.

Foaming nozzle 130 is mounted on carriage 34 so that it can reciprocate horizontally, by reciprocator 131, as a foamable mixture is sprayed from it and directed against wall 16. Suitable apparatus for moving the nozzle is known in the art. See for example U.S. Pat. Nos. 4,167,151; 3,991,842 and 3,548,453, the entire disclosure of which is incorporated herein by reference.

The means 38 supported by track 32 for releasably securing the track against movement lateral to the walls 14 and 16, and sideways in space 30, comprises a vacuum box. The vacuum box comprises a flat plate 132 having a raised area on the rear face around its peripheral edge. A soft flexible gasket 134 is set in a groove in the raised area. Vacuum conduit 136 communicates with a hole extending through plate 132. By creating a vacuum between plate 132 and wall 14, when gasket 134 is in contact therewith, atmospheric pressure forces the vacuum box tightly against wall 14. Arms 138 and 140 extend from the vacuum box to two adjoining rungs 48 thereby securing it to the track. Although the use of only one vacuum box is illustrated in the drawings as many as desired can be attached to the track to hold it firmly in place when insulation foam is being deposited. This is highly desirable since the rapid reciprocal movement of foaming nozzle 130 most likely would otherwise cause the track to shake unsafely.

The described apparatus is used to deposit a layer of foam insulation 150 by first positioning it in a tank, with the carriage initially desirably at the bottom of the track. The foam nozzle 130 is then activated to spray horizontal passes about 3 to 5 feet wide. Simultaneously, winch 96 is started so as to wind wire rope 100 thereon at a predetermined rate, thereby lifting carriage 34 while spraying proceeds. This operation is continued until the carriage reaches its uppermost point of travel on the track. Spraying of foam and movement are then terminated substantially simultaneously. It is obvious that the vertical strip of foamed insulation deposited as described will not extend to the full height of wall 16 unless the foaming nozzle can move upwardly, while it reciprocates horizontally, from a position at the bottom of the carriage to a position near the top of the carriage after further upward movement of the carriage is prevented by the top of the carriage 34 contacting the bottom of cage 60. This can be accomplished by automatic means at the appropriate time as, for example, by the use of vertical screws which lift the nozzle reciprocating system. However, it is also feasible to finish insulating the top part of wall 16 by manual deposition of foamed insulation.

After a vertical strip of foamed insulation is deposited as described, the apparatus can be moved to one side or the other of the previous strip and the next strip deposited adjoining or spaced from the previous strip. Spaces between strips can be filled as appropriate using the described apparatus and method.

What is claimed is:

1. Apparatus for applying a coating to one of two walls forming a narrow vertical elongated space, comprising:

a vertical guide track supporting a vertically displaceable carriage thereon adapted to removeably fit in the said narrow vertical elongated space;

power driven means for vertically displacing the carriage; and means supported by the guide track for releasably securing the guide track against movement lateral to the two walls and sideways in the narrow vertical elongated space.

2. Apparatus according to claim 1 in which the vertical guide track height is at least as high as the narrow vertical elongated space.

3. Apparatus according to claim 1 in which the guide track has at least two vertical spaced apart parallel rails and the carriage is mounted on the rails for vertical displacement.

4. Apparatus according to claim 1 in which the power driven means for vertically displacing the carriage includes a reversible winch supported by the track and a wire rope operatively wound on the winch and connected to the carriage to displace the carriage upwardly.

5. Apparatus according to claim 1 including roller means about at the top portion of the guide track for suspending the track in the narrow vertical elongated space on a horizontal member connected to one of the walls.

6. Apparatus according to claim 1 including spray means on the carriage for applying a coating to one of the wall surfaces as the carriage is displaced vertically.

7. Apparatus according to claim 6 in which the spray means includes reciprocating means for applying the coating as horizontal passes of predetermined length so that a coating is applied as a vertical band with vertical displacement of the carriage.

8. Apparatus according to claim 1 or 6 including means on the carriage for remote observation of the wall area being coated.

9. Apparatus according to claim 1 in which the means for releasably securing the guide track against movement lateral to the two walls or sideways in the narrow vertical elongated space includes a vacuum box on the guide track which is attachable to one of the walls by a vacuum.

10. Apparatus according to claim 1 in which the guide track has rollers on the lower end which are adapted to cooperate with a rail at the bottom of the elongated space to keep the track in position relative to the walls of the elongated space.

* * * * *